United States Patent [19]

Retherford

[11] Patent Number: 4,665,976

[45] Date of Patent: May 19, 1987

[54] FLUID DEFLECTION SHIELD ASSEMBLY

[76] Inventor: Simon Retherford, R.R. #1, Box 244, Cushing, Okla. 74023

[21] Appl. No.: 794,376

[22] Filed: Nov. 4, 1985

[51] Int. Cl.[4] ..... E21B 33/08

[52] U.S. Cl. ..... 166/81; 166/84; 166/93; 277/32; 74/18.2

[58] Field of Search ..... 166/81, 85, 93, 96, 166/84, 88, 82, 97; 74/18.2; 277/30, 32

[56] References Cited

U.S. PATENT DOCUMENTS

| | | | |
|---|---|---|---|
| 2,096,882 | 10/1937 | Chernosky | 166/81 |
| 2,743,122 | 4/1956 | Ratigan | 277/32 |
| 2,867,997 | 1/1959 | Lake | 277/32 |
| 3,186,722 | 6/1965 | Johnston | 74/18.2 |
| 3,270,810 | 9/1966 | Johnston | 166/81 |

*Primary Examiner*—Stephen J. Novosad
*Assistant Examiner*—Terry Lee Melius
*Attorney, Agent, or Firm*—William S. Dorman

[57] ABSTRACT

A fluid deflection shield assembly for use with an oil well pump having a polished rod reciprocating within a stuffing box and providing a fluid-tight seal entirely around the stuffing box and the polished rod whereby the fluid deflection shield assembly may be attached or removed without interrupting the operation of the oil well. The fluid deflection shield assembly includes a bottom pan having a hole to receive the stuffing box, a gasket between the bottom pan and the stuffing box, a conical shell adapted to surround the stuffing box, a seal in the top of the conical shell between the conical shell and the reciprocating polished rod, clamps connecting the base of the conical shell and the bottom pan, and lubricating means in the conical shell to lubricate the polished rod. The bottom pan has an arcuate front section and an arcuate rear section, with the arcuate front section having a semi-circular hole which mates with a semi-circular hole provided on the arcuate rear section to form the hole to receive the stuffing box. Clamps are provided to connect the arcuate front and arcuate rear sections of the bottom pan. At least one drainage hole is provided in the bottom pan for removing liquid. The conical shell has an arcuate front section and an arcuate rear section, the arcuate front section having a semi-circular hole which mates with a semi-circular hole on the arcuate rear section to form a hole to receive the reciprocating polished rod. Clamps connect the arcuate front and arcuate rear sections of the conical shell.

4 Claims, 6 Drawing Figures

FLUID DEFLECTION SHIELD ASSEMBLY

BACKGROUND OF THE INVENTION

1. Field of the Invention

The present invention relates to a fluid deflection shield assembly for use with an oil well pump stuffing box to prevent pumped fluid from spraying in the event of failure of the stuffing box.

2. Prior Art

In the usual oil well, a well head, located at the surface of the bore hole, includes a stuffing box containing a packing gland screwed in the top of the well head through which a polished or pump rod reciprocates. The stuffing box prevents the escape of fluid past the polished rod, diverting it into a side outlet which is connected to a flow line.

The packing is subject to wear from airborne dust and dirt. The packing is also subject to wear at times when the well is pumping dry. If the packing wears excessively, the seal will be broken. The fluid will escape and will be sprayed in various directions.

In the event of stuffing box failure, considerable damage may be caused to crops, livestock and water supplies in the surrounding vicinity.

Therefore, it is a principal object and purpose of the present invention to provide a deflection shield assembly having a fluid-tight seal entirely around the stuffing box and the polished rod.

It is a further object and purpose of the present invention to provide a fluid deflection shield assembly of simple design and construction which may be attached or removed without dismantling the stuffing box and without interrupting the operation of the oil well.

It is an additional object and purpose of the present invention to provide a fluid deflection shield assembly which will prevent dispersion of the pumped fluid in the event of failure of the stuffing box.

A patentability search was conducted on the present invention and the following U.S. patents were uncovered in the search:

| U.S. Pat. No. | Patentee | Issue Date |
|---|---|---|
| 3,953,037 | Winfield, Jr. | April 27, 1976 |
| 3,186,722 | Johnston | June 1, 1965 |
| 4,086,819 | Brownlee | May 2, 1978 |
| 3,353,606 | Dyer | November 21, 1967 |
| 3,270,810 | Johnston | September 6, 1966 |
| 3,369,411 | Hines | February 20, 1968 |
| 3,796,103 | Winfield, Jr. | March 12, 1974 |
| 3,886,804 | Winfield, Jr. | June 3, 1975 |

Johnston (U.S. Pat. No. 3,186,722) provides a simple deflection bonnet surrounding the stuffing box. An open bottom, however allows fluid to leak to the ground and no seal is provided at the top between the deflection shield and polished rod, thereby allowing fluid to leak through the clearance left for mechanical reasons.

Johnston (U.S. Pat. No. 3,270,810) provides a fluid deflection shield which is attached in a cumbersome manner through use of a chain and clamp. The upper seal with the polished rod is subject to wear from abrasion due to dust dirt being blown against the polished rod.

Winfield, Jr. (U.S. Pat. No. 3,796,103) discloses a deflection device which does not surround the stuffing box but merely deflects any upward movement of fluid.

Additionally, the pumping operation must be stopped while the device is attached or removed.

Hines (U.S. Pat. No. 3,369,411) discloses a simple accordian-like device to protect the polished rod but does not address the problem of stuffing box failure.

The other patents listed above are not considered sufficiently pertinent to require any comments.

SUMMARY OF THE INVENTION

The present invention provides a fluid deflection shield assembly for maintaining a liquid-tight seal entirely around a stuffing box having a polished rod reciprocating therethrough. The fluid deflection shield assembly may be attached or removed without interrupting the operation of the oil well.

A bottom pan consists of an arcuate front section and an arcuate rear section. The arcuate front section is provided with a semi-circular opening which mates with a semi-circular opening on the arcuate rear section to form an opening to receive the base of the stuffing box. Gaskets are provided on the arcuate sections of the bottom pan which communicate with the base of the stuffing box. The sections of the bottom pan are held together with releasable clamps. Discharge openings are provided in the pan to drain liquid that will accumulate in the event of stuffing box failure.

A conical shell, consisting of an arcuate front section and an arcuate rear section, is held together by a plurality of releasable clamps. The conical shell has an open base which nests in the bottom pan. The shell is secured to the bottom pan by releasable clamps. Arcuate trays within the conical shell are adapted to surround the polished rod. Each tray has a wick adapted to snugly fit in a space provided between the tray and the reciprocating polished rod to maintain lubrication. Spouts extend through openings provided in the conical shell to facilitate filling the trays with lubricant. Caps are provided to cover the spouts.

A pliable ring gasket is adapted to fit in a space between the top of the conical shell and the reciprocating polished rod. The gasket is split to permit placement around the polished rod.

To attach the fluid deflection shield assembly, the sections of the bottom pan are placed around the base of the stuffing box and the clamps are closed. The gasket is placed around the polished rod and the sections of the conical shell are clamped together. The conical shell is then clamped to the bottom pan.

DETAILED DESCRIPTION OF THE PREFERRED EMBODIMENTS

Figure 1:
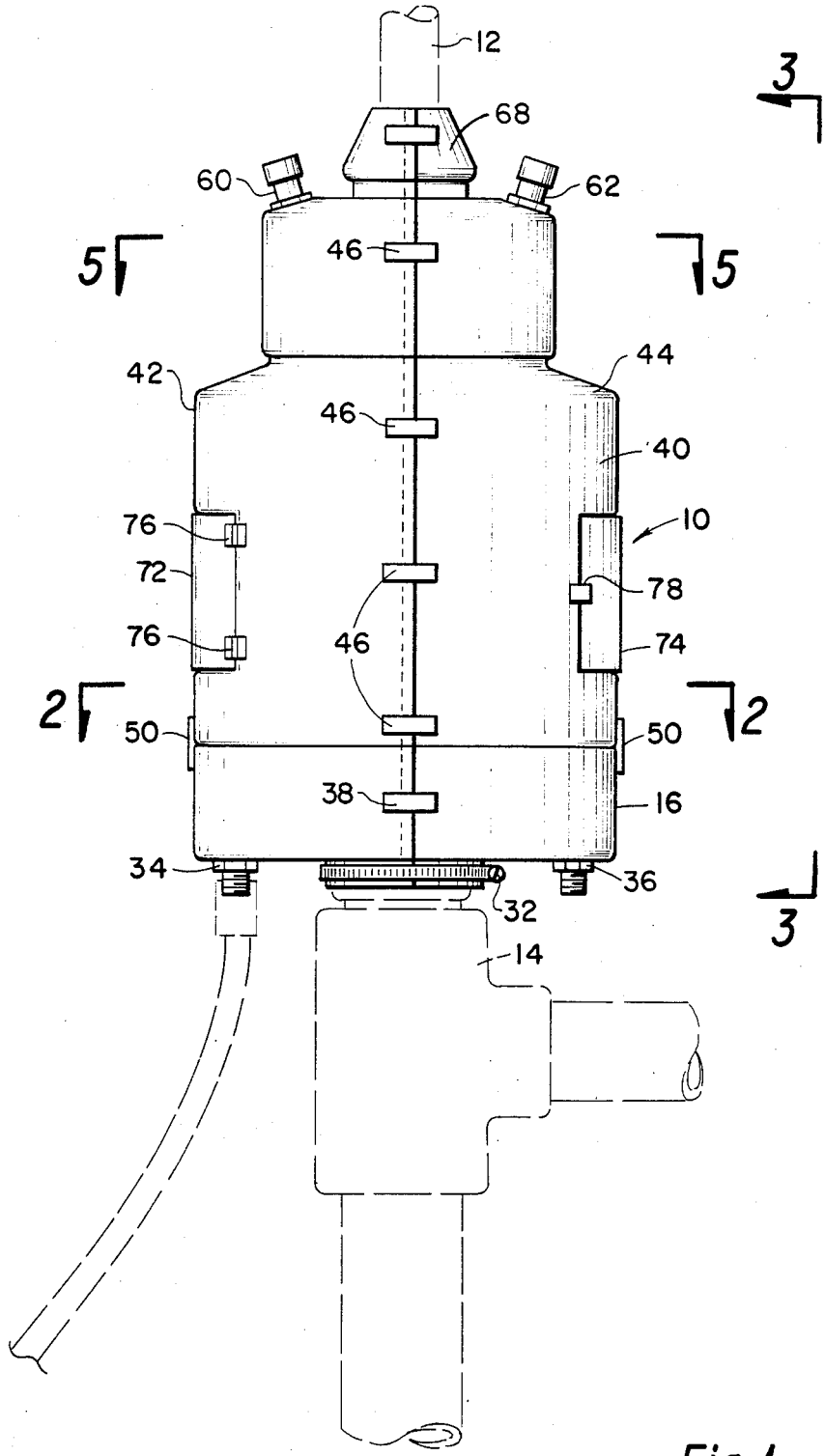
FIG. 1 is a front view of a fluid deflection shield assembly which is constructed in accordance with one embodiment of the present invention.

Referring to the drawings in detail, FIGS. 1 through 6 show a fluid deflection shield assembly 10 for maintaining a liquid-tight seal around a stuffing box assembly having a polished rod 12 reciprocating therethrough. FIG. 1 shows a fluid deflection shield assembly 10 attached to the stuffing box (not shown in FIG. 1) above the well head 14. The fluid deflection shield assembly may be constructed of any lightweight material, such as a high-grade plastic, that withstands oil, salts, water and other fluids.

Figure 2:
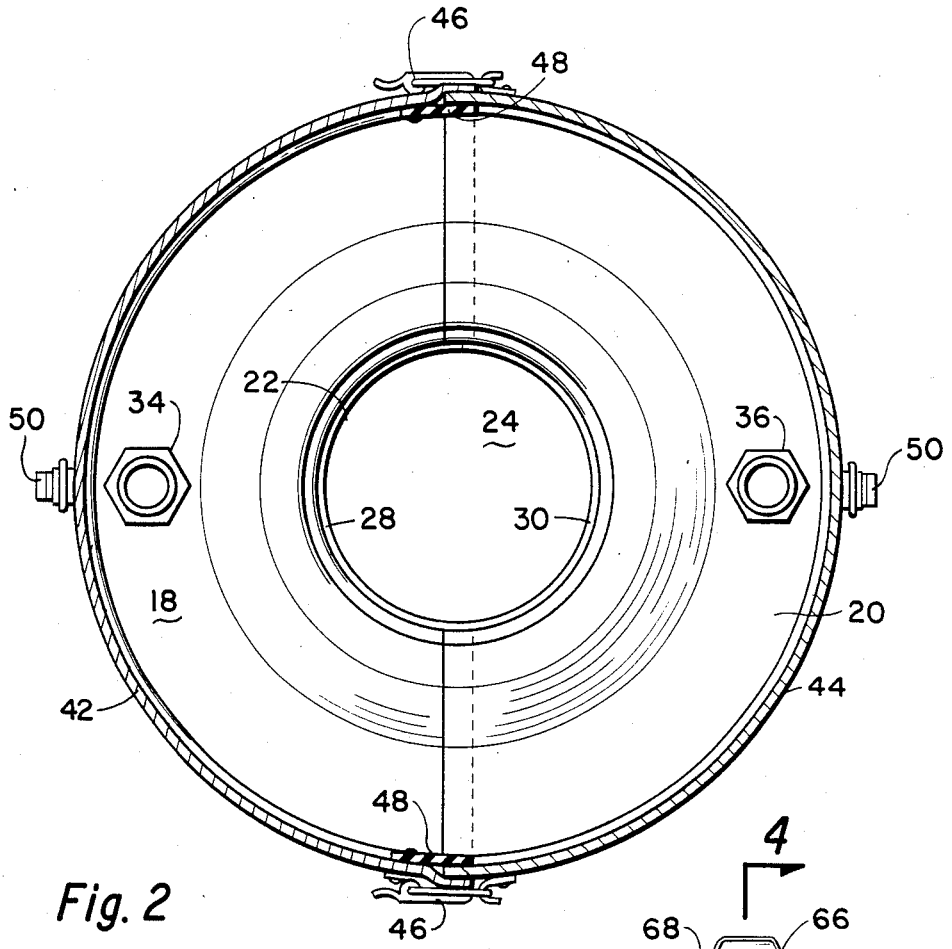
FIG. 2 a sectional view of the fluid deflection shield assembly shown in FIG. 1 taken along section line 2—2 of FIG. 1.
Figure 3:
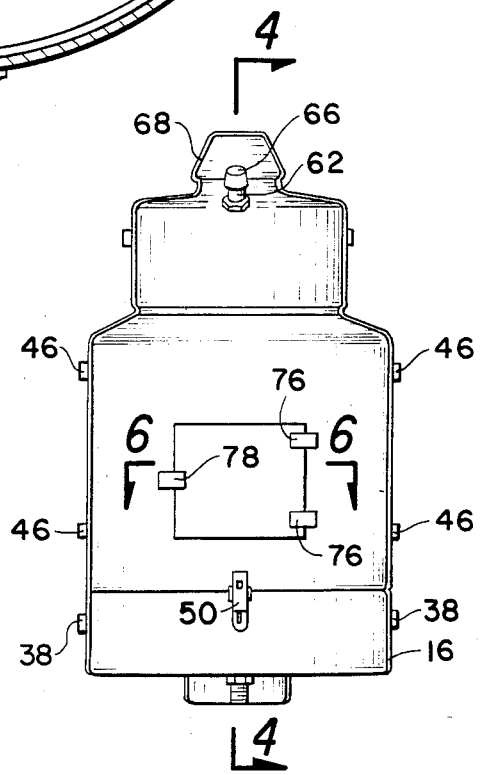
FIG. 3 is a sectional view of the fluid deflection shield assembly shown in FIG. 1 taken along section line 3—3 of FIG. 1.

As will be seen, the fluid deflection shield may be attached or removed without dismantling or disconnecting the well head or the stuffing box. As best seen in FIG. 2, a bottom pan 16 consists of an arcuate front section 18 and an arcuate rear section 20. The arcuate front section 18 is provided with a semi-circular opening 22 which mates with a semi-circular opening 24 on the arcuate rear section 20 to form an opening to receive the base of the stuffing box (not shown in FIGS. 1 or 2).

Figure 4:
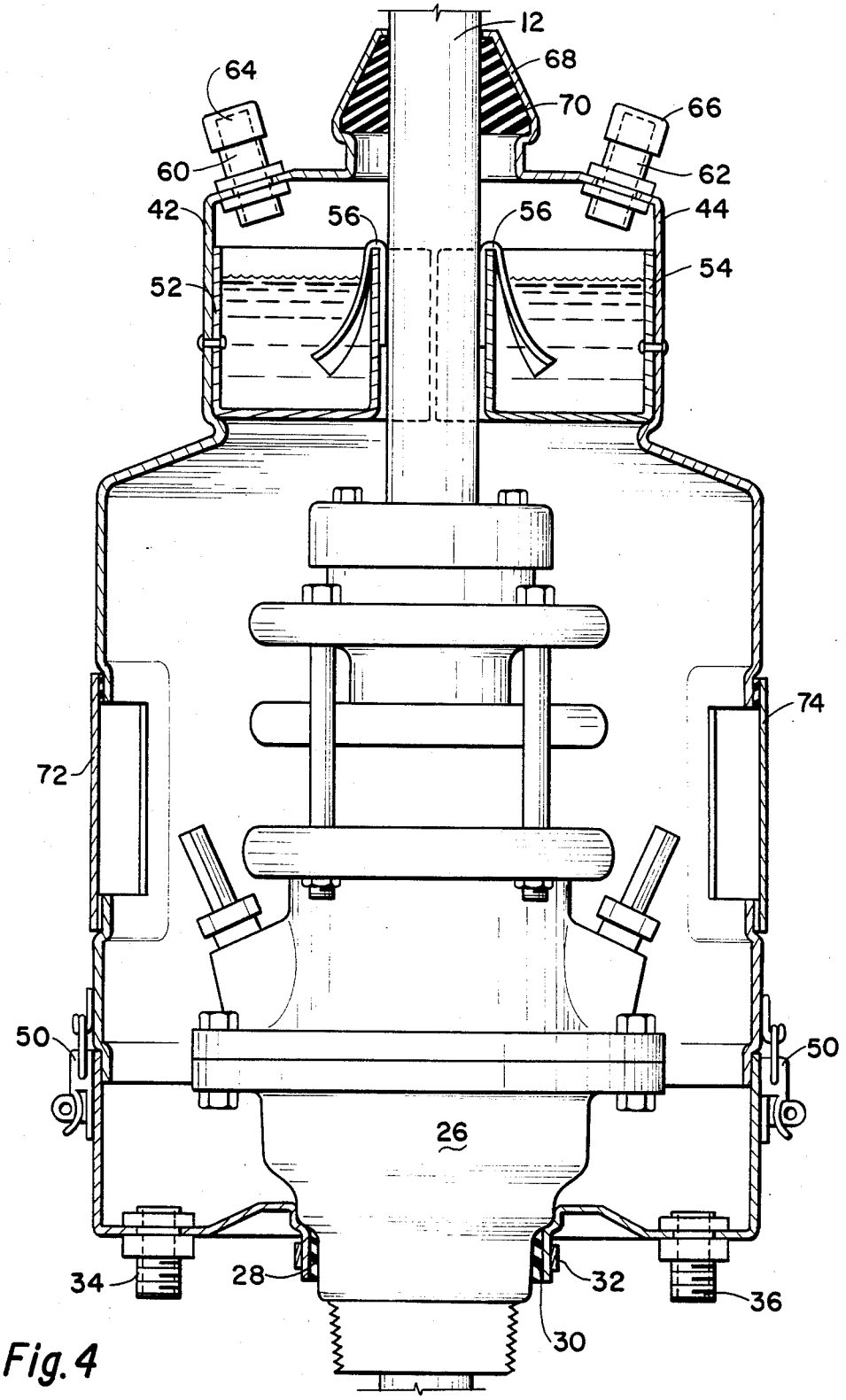
FIG. 4 is a sectional view of the fluid deflection shield assembly shown in FIG. 1 taken along section line 4—4 of FIG. 3.

FIG. 4 shows the present invention cut away to reveal the stuffing box 26 enclosed therein. Gaskets 28 and 30 are provided on the arcuate sections 18 and 20, respectively, which communicate with the base of the stuffing box held in place by a band clamp 32. Discharge openings 34 and 36 are provided to drain liquid that will accumulate in the event of failure of the stuffing box 24. A hose and a receptacle, such as a barrel, may be used to retain the fluids. It should be understood that although two drainage openings are utilized in the present embodiment, a single drainage opening might be used.

The front section 18 and rear section 20 of the bottom pan 16 are held together by releasable clamps 38.

Returning to a consideration of FIGS. 1, 2, 3, and 4, a conical shell 40 consists of an arcuate front section 42 and an arcuate rear section 44. Sections 42 and 44 are held together by a plurality of releasable clamps 46. As seen in FIG. 2, gaskets 48 are provided to improve the seal between sections 42 and 44. The shell 40 has an open base which nests in the bottom pan 16. The shell is secured to the bottom pan by a plurality of releasable clamps 50.

Figure 5:
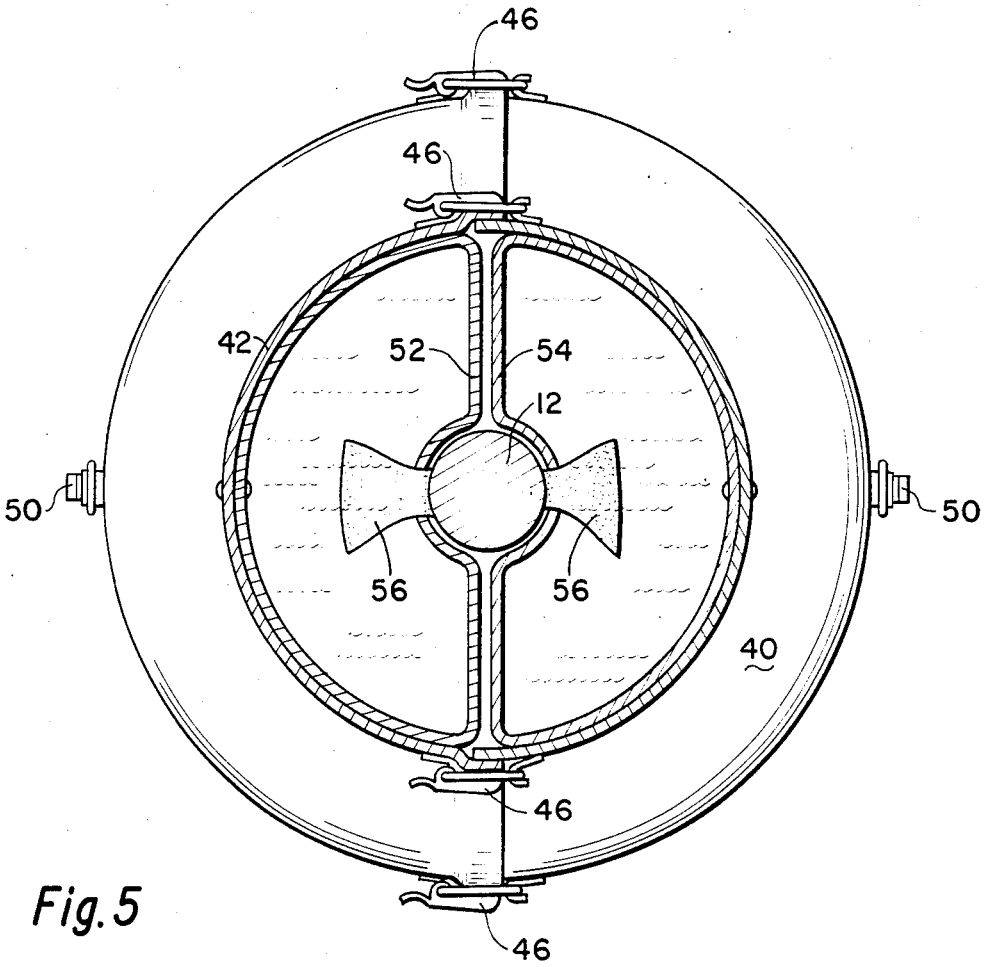
FIG. 5 is a sectional view of the fluid deflection shield assembly shown in FIG. 1 taken along section line 5—5 of FIG. 1.

As best seen in FIGS. 4 and 5, arcuate trays 52 and 54 within conical shell 40 are adapted to surrround the polished rod 12. Each tray has a wick 56 adapted to snugly fit in a space provided between the tray and the reciprocating polished rod 12. The wick is thus pressed against the polished rod and, as the polished rod reciprocates, will maintain lubrication. Spouts 60 and 62 extend through openings provided in the conical shell. The spouts may be used to replenish lubricant held in the trays 50 and 52, respectively. Caps 64 and 66 cover spouts 60 and 62, respectively.

Figure 6:
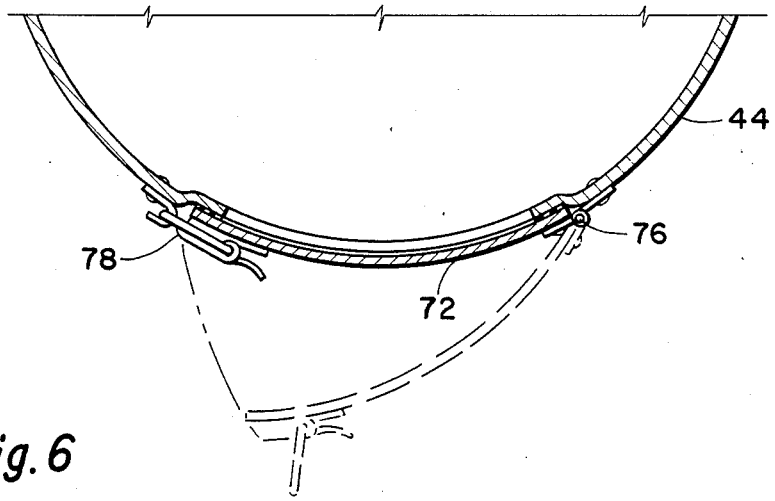
FIG. 6 is a sectional view of an optional inspection door to be used with the fluid deflection shield assembly shown in FIG. 1 taken along section line 6—6 of FIG. 3.

In the top 68 of the conical shell 40 is a pliable ring gasket 70 adapted to fit in a space between the top 68 of the conical shell and the reciprocating polished rod 12. The ring gasket 70 is split (not shown) to permit the gasket to be placed around the polished rod 12. As best seen in FIGS. 4 and 6, optional doors 72 and 74 are provided on sections 42 and 44, respectively, so that the stuffing box may be observed without removing the present invention. Hinges 76 and releasable clamps 78allow the doors to operate.

In order to attach the fluid deflection shield assembly, the sections 18 and 20 of the bottom pan 16 are placed around the base of the stuffing box 24 and the clamps 38 are closed. The ring gasket 70 is placed around the polished rod and the sections 42 and 44 of the conical shell 40 are clamped together around the stuffing box 24. Finally, the conical shell is clamped to the bottom pan 16. A liquid-tight seal is thereby created so that any fluid escaping from the stuffing box will be trapped and directed out of the discharge openings. To remove the device, the reverse operation is performed.

Whereas, the present invention has been described in particular relation to the drawings attached hereto, it should be understood that other and further modifications of the invention, apart from those shown or suggested herein, may be made within the spirit and scope of this invention.

What is claimed is:

1. A fluid deflection shield assembly for use with an oil well pump having a polished rod reciprocating within a stuffing box seal assembly and providing a liquid-tight seal around said stuffing box and said polished rod wherein said fluid deflection shield assembly comprises: a bottom pan having an arcuate front section and an arcuate rear section, said arcuate front section having a semi-circular hole which mates with a semi-circular hole provided on said arcuate rear section to form a hole to receive said stuffing box; clamp means connecting said arcuate front and arcuate rear sections of said bottom pan; a gasket on said arcuate front section and said arcuate rear section adapted to receive said stuffing box; at least one drainage hole in said bottom pan for removing liquid; a conical shell adapted to surround said stuffing box, said shell having an arcuate front section and an arcuate rear section, said arcuate front section having a semi-circular hole which mates with a semi-circular hole provided on said arcuate rear section to receive said polished rod; clamp means connecting said arcuate front and arcuate rear sections of said conical shell; seal means in the top of said conical shell to provide a seal between said conical shell and said reciprocating polished rod; clamp means connecting the base of said conical shell and said bottom pan; and lubricating means within said conical shell to lubricate said polished rod including at least one arcuate tray within said conical shell to hold lubricating fluid and a wick extending between said tray and said polished rod and adapted to fit in a space provided between said tray and said polished rod.

2. A fluid deflection shield assembly as provided in claim 1 wherein said conical shell includes at least one spout extending through an opening provided in said conical shell for filling said tray with lubricating fluid and at least one cap to cover said spout.

3. A fluid deflection shield assembly for use with an oil well pump having a polished rod reciprocating within a stuffing box seal assembly and providing a liquid-tight seal around said stuffing box and said polished rod wherein said fluid deflection shield assembly comprises: a bottom pan having an arcuate front section and an arcuate rear section, said arcuate front section having a semi-circular hole which mates with a semi-circular hole provided on said arcuate rear section to form a hole to receive said stuffing box; clamp means connecting said arcuate front and arcuate rear sections of said bottom pan; a gasket on said arcuate front section and said arcuate rear section adapted to receive said stuffing box; at least one drainage hole in said bottom pan for removing liquid; a conical shell adapted to surround said stuffing box, said shell having an arcuate front section and an arcuate rear section, said arcuate front section having a semi-circular hole which mates with a semi-circular hole provided on said arcuate rear section to receive said polished rod and wherein said shell includes at least one inspection door to allow viewing of said stuffing box seal assembly; clamp means connecting said arcuate front and arcuate rear sections of said conical shell; seal means in the top of said conical shell to provide a seal between said conical shell and said reciprocating polished rod; clamp means connecting the base of said conical shell and said bottom pan; and lubricating means within said conical shell to lubricate said polished rod.

4. A fluid deflection shield as provided in claim 3 including a spout and a cap for said spout, and wherein said conical shell includes at least one opening to receive said spout for adding lubricant to said tray.

* * * * *